US007176872B2

(12) United States Patent
Kuriki

(10) Patent No.: US 7,176,872 B2
(45) Date of Patent: Feb. 13, 2007

(54) DISPLAY CONTROLLER, DISPLAY SYSTEM, AND DISPLAY CONTROLLING METHOD

(75) Inventor: Shinji Kuriki, Koufu (JP)

(73) Assignees: Pioneer Corporaion, Tokyo-to (JP); Pioneer Micro Technology Corporation, Yamanashi-ken (JP)

( * ) Notice: Subject to any disclaimer, the term of this patent is extended or adjusted under 35 U.S.C. 154(b) by 503 days.

(21) Appl. No.: 10/705,832

(22) Filed: Nov. 13, 2003

(65) Prior Publication Data

US 2004/0100429 A1 May 27, 2004

(30) Foreign Application Priority Data

Nov. 21, 2002 (JP) ..... P2002-338405

(51) Int. Cl.
*G09G 3/38* (2006.01)
*G09G 3/20* (2006.01)

(52) U.S. Cl. ..... 345/98; 345/99

(58) Field of Classification Search ..... 345/87, 345/94, 98, 99, 100, 58
See application file for complete search history.

(56) References Cited

U.S. PATENT DOCUMENTS 5,805,130 A * 9/1998 Yamamoto et al. ..... 345/100
6,693,618 B2 * 2/2004 Son et al. ..... 345/99
2003/0090449 A1 * 5/2003 Arimoto et al. ..... 345/87

* cited by examiner

*Primary Examiner*—Dennis-Doon Chow
(74) *Attorney, Agent, or Firm*—Sughrue Mion, PLLC

(57) ABSTRACT

A display controller is provided which can control the display of a fast moving image with higher quality in an active matrix display apparatus DD.

When the display pattern of an image is controlled in a display apparatus DD constituted of a plurality of pixels S arranged in a matrix form, the pixel including a light-emitting device, an image is displayed by driving the pixels S only for predetermined illuminating period shorter than a vertical synchronizing period.

1 Claim, 7 Drawing Sheets

BLOCK DIAGRAM SHOWING THE SCHEMATIC CONFIGURATION OF A DISPLAY DEVICE ACCORDING TO EMBODIMENT 1

BLOCK DIAGRAM SHOWING THE SCHEMATIC CONFIGURATION OF A DISPLAY DEVICE ACCORDING TO EMBODIMENT 1

BLOCK DIAGRAM SHOWING THE DETAILED CONFIGURATION OF A DISPLAY DEVICE ACCORDING TO EMBODIMENT 1

TIMING CHART SHOWING A DRIVING STATE OF A DISPLAY DEVICE ACCORDING TO EMBODIMENT 1

BLOCK DIAGRAM SHOWING THE SCHEMATIC CONFIGURATION OF A DISPLAY DEVICE ACCORDING TO EMBODIMENT 2

TIMING CHART (I) SHOWING A DRIVING STATE OF A DISPLAY DEVICE ACCORDING TO EMBODIMENT 2

TIMING CHART (II) SHOWING A DRIVING STATE OF A DISPLAY DEVICE ACCORDING TO EMBODIMENT 2

TIMING CHART SHOWING A DRIVING STATE OF A DISPLAY DEVICE ACCORDING TO EMBODIMENT 3

DISPLAY CONTROLLER, DISPLAY SYSTEM, AND DISPLAY CONTROLLING METHOD

BACKGROUND OF THE INVENTION

1. Field of the Invention

The present invention relates to a technical field of a display controller, a display system, and a display controlling method. To be specific, the present invention relates to a technical field of a display controller for controlling a display pattern in a matrix display apparatus, a display system including the display controller and the display apparatus, and a display controlling method performed in the display controller.

2. Description of the Related Art

In recent years thin display apparatuses such as a liquid crystal display apparatus and an organic electro luminescence (EL) display apparatus have become prevalent which have an advantage in its installation location.

For the image display of conventional liquid crystal display apparatuses or organic EL display apparatuss, the following display method is generally adopted: in a vertical synchronizing period from when voltage information is supplied to each pixel constituting a display screen to when the subsequent voltage information is supplied, the supplied voltage information is stored by using a pixel capacity formed in each pixel, so that light emission from the pixel is continued.

However, according to the display method of the conventional liquid crystal display apparatus and so on, the supplied voltage information is stored using a pixel capacity during one vertical synchronizing period all, so that light emission from the pixel is continued. As a result, an afterimage resulting from human vision is more likely to occur. Such an afterimage reduces display quality. For example, a fast moving image cannot be clearly displayed.

SUMMARY OF THE INVENTION

The present invention is devised in view of the above problem. An object of the present invention is to provide a display controller for controlling the display of a fast moving image with higher quality in a active matrix display apparatus constituted of a plurality of pixels, each including an active element, to provide a display system including the display controller and the display apparatus, and to provide a display controlling method performed in the display controller.

The above object of the present invention can be achieved by a display controller for controlling a display pattern of an image in a display apparatus constituted of a plurality of pixels arranged in a matrix form, the each pixel including a pixel-driving device. The display controller is provided with a driving control device for controlling an operation of the pixel-driving devices, based on image information corresponding to the image to be displayed during a synchronizing period of one synchronizing direction, only for predetermined illuminating period shorter than the synchronizing period.

According to the display controller, the pixel-driving devices in the pixels are driven to display an image only in the illuminating period shorter than one vertical synchronizing period. Thus, it is possible to reduce the influence of an afterimage in human vision and control the display of a fast moving image with higher quality.

In one aspect of the display controller, the driving control device simultaneously drives all the pixel-driving devices based on the image information only during the illuminating period.

According to this aspect, since all the pixel-driving devices are driven based on the image information only during the illuminating period, it is possible to reduce the influence of an afterimage in human vision and control the display of a fast moving image with higher quality.

In another aspect of the display controller, the driving control device drives, based on the image information, the pixel-driving devices which are on one scanning line during the synchronizing period so as to line-sequentially perform scanning.

According to this aspect, since the pixel-driving devices which are on one scanning line during the synchronizing period so as to line-sequentially perform scanning, it is possible to reduce the influence of an afterimage in human vision and control the display of a fast moving image with higher quality.

In further aspect of the display controller, the driving control device drives the pixel-driving devices on the adjacent two or more scanning lines included in a scanning-line-group simultaneously, and drives the pixel-driving devices in the scanning-line-group in a direction perpendicular to the scanning direction of the scanning line while displacing the scanning line one after another.

According to this aspect, since the pixel-driving devices on the adjacent two or more scanning lines included in the scanning-line-group are driven simultaneously and the pixel-driving devices in the scanning-line-group are driven in a direction perpendicular to the scanning direction of the scanning line while displacing the scanning line one after another, it is possible to reduce the influence of an afterimage in human vision and control the display of a fast moving image with higher quality.

In further aspect of the display controller, the driving control device drives the pixel-driving devices on the scanning lines, for each of a plurality of scanning-line-groups each being constituted of the adjacent two or more scanning lines and including a different number of the scanning lines, drives the pixel-driving devices in the scanning-line-group simultaneously, and drives the pixel-driving devices in the scanning-line-group in a direction perpendicular to the scanning direction of the scanning line while displacing the scanning line one after another.

According to this aspect, since the pixel-driving devices on the adjacent two or more scanning lines included in the scanning-line-group are driven simultaneously, for each of a plurality of scanning-line-groups each being constituted of the adjacent two or more scanning lines and including a different number of the scanning lines, and are driven in a direction perpendicular to the scanning direction of the scanning line while displacing the scanning line one after another, it is possible to perform control to clearly display the moving image even when gray scale display is provided for the moving image.

In further aspect of the display controller, the display control device drives the pixel-driving devices in each scanning-line-group during the synchronizing, and the number of the scanning lines of each scanning-line-group is simply increased or simply reduced along the synchronizing direction.

According to this aspect, since the pixel-driving devices in each scanning-line-group are driven during the synchronizing, and the number of the scanning lines of each scanning-line-group is simply increased or simply reduced along the synchronizing direction, it is possible to correctly control the gray scale display in the display of the moving image.

In further aspect of the display controller, the synchronizing period in the image information is constituted of a plurality of sub synchronizing periods each having a different weight of an image display period, the driving control device performs selection writing scanning for line-sequentially scanning the pixel-driving device on the scanning line corresponding to the sub synchronizing period based on the image information and placing the pixel on the scanning line into an image display state in each of the sub synchronizing periods, and the driving control device performs non-display scanning for line-sequentially scanning the pixel-driving devices on the scanning line to be subjected to the selection writing scanning and placing all the pixels on the scanning line into an image non-display state before starting the selection writing scanning on the scanning line.

According to this aspect, since selection writing scanning is performed in each of the sub synchronizing periods to place the pixels on the corresponding scanning lines into an image display state based on moving image information and a non-display scanning is performed to place into an image non-display state all of the pixels on the scanning lines to be subjected to the selection writing scanning before the selection writing scanning is started on the scanning lines, it is possible to reduce the occurrence of a moving image false contour when gray scale display is provided by the sub synchronizing period method.

The above object of the present invention can be achieved by a display system. The display system is provided with: a display controller for controlling a display pattern of an image in a display apparatus constituted of a plurality of pixels arranged in a matrix form, the each pixel including a pixel-driving device, the display controller comprising a driving control device for controlling an operation of the pixel-driving devices, based on image information corresponding to the image to be displayed during a synchronizing period of one synchronizing direction, only for predetermined illuminating period shorter than the synchronizing period, and the display apparatus.

According to the display system, the pixel-driving devices in the pixels are driven to display an image only in the illuminating period shorter than one vertical synchronizing period. Thus, it is possible to reduce the influence of an afterimage in human vision and control the display of a fast moving image with higher quality.

The above object of the present invention can be achieved by a display controlling method for controlling a display pattern of an image in a display apparatus constituted of a plurality of pixels arranged in a matrix form, the pixel including a pixel-driving device. The display controlling method is provided with a driving controlling process for controlling an operation of the pixel-driving device, based on image information corresponding to the image to be displayed during a synchronizing period of one synchronizing direction, only for predetermined illuminating period shorter than the synchronizing period.

According to the display controlling method, the pixel-driving devices in the pixels are driven to display an image only in the illuminating period shorter than one vertical synchronizing period. Thus, it is possible to reduce the influence of an afterimage in human vision and control the display of a fast moving image with higher quality.

DETAILED DESCRIPTION OF THE PREFERRED EMBODIMENTS

Preferred embodiments of the present application will be described below in accordance with the accompanying drawings.

The following will describe embodiments in which the present invention is applied to a drive in an active matrix display apparatus such as an organic EL display. The active matrix display has a driving element such as a thin film transistor (TFT) in each pixel to display a moving image and so on.

(I) Embodiment 1

Figure 1:
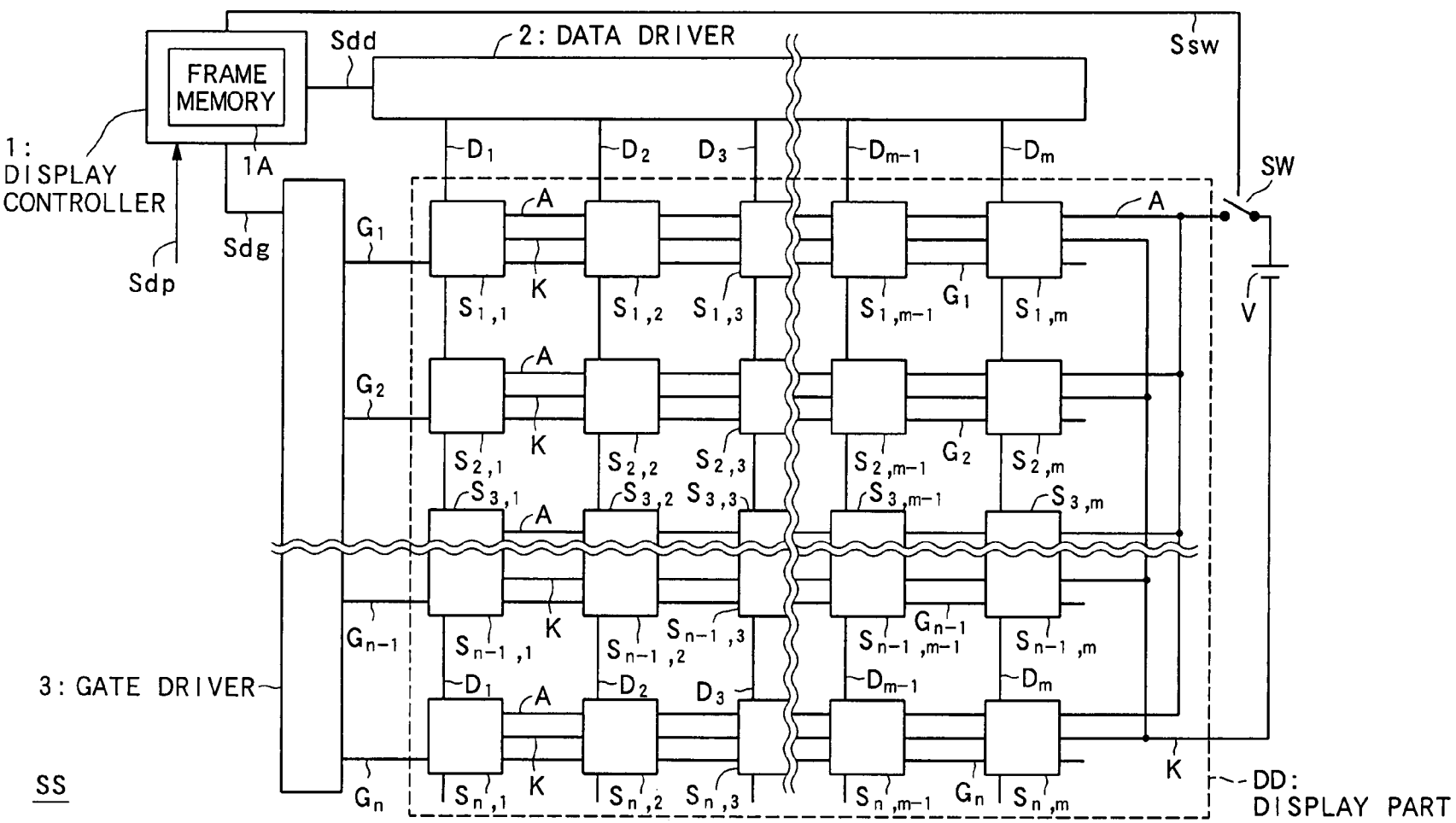
FIG. 1 is a block diagram showing the schematic configuration of a display apparatus according to Embodiment 1.
Figure 2:
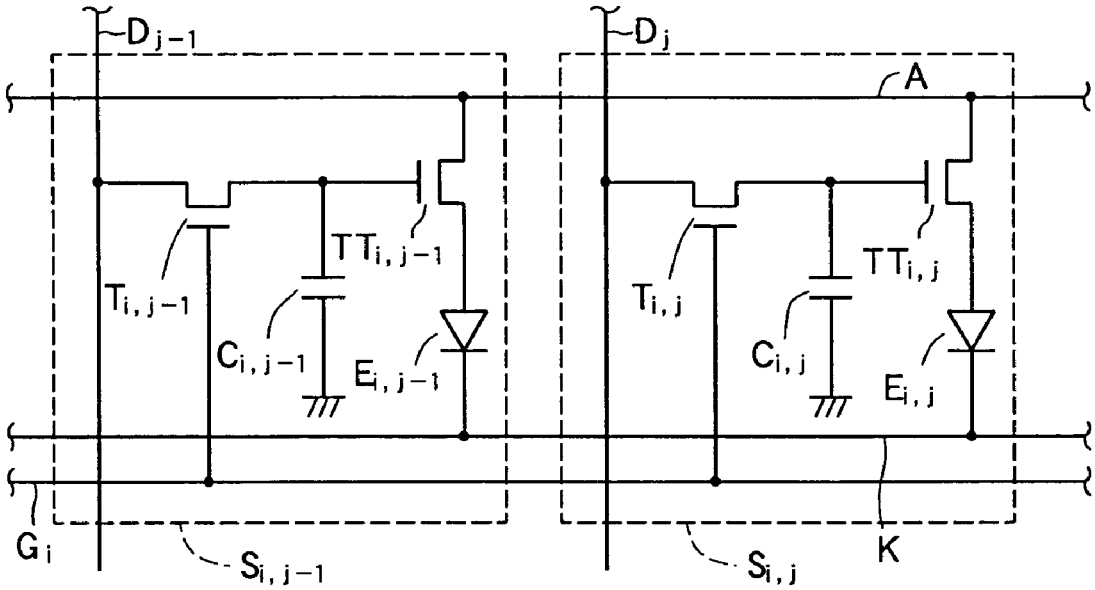
FIG. 2 is a block diagram showing the detailed configuration of the display apparatus according to Embodiment 1.
Figure 3:
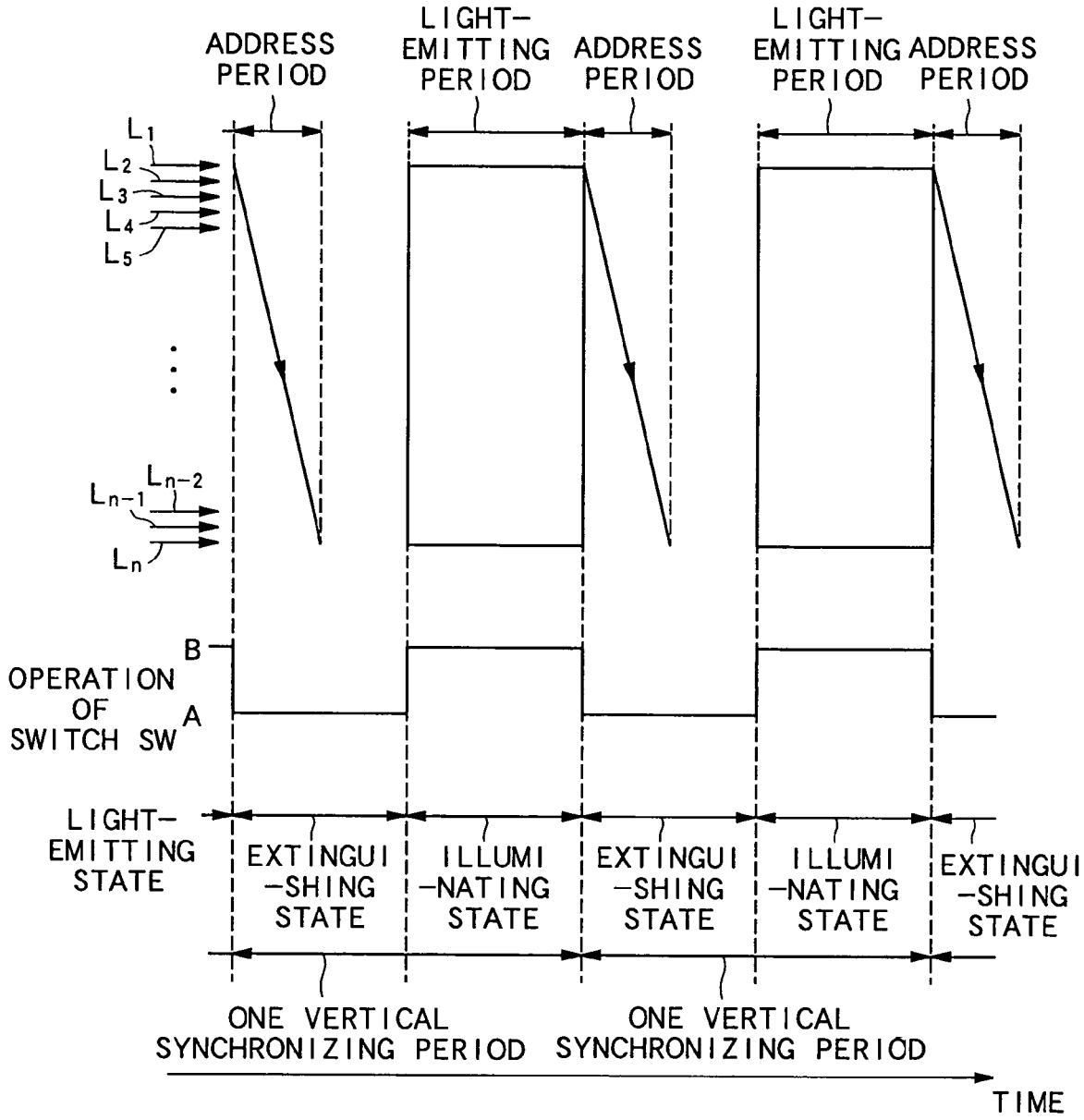
FIG. 3 is a timing chart showing a driving state of the display apparatus according to Embodiment 1.

Referring to FIGS. 1 to 3, Embodiment 1 of the present invention will be firstly described.

FIG. 1 is a block diagram showing the schematic configuration of a display apparatus according to Embodiment 1. FIG. 2 is a circuit diagram showing the configuration of elements in each pixel included in a display part of the display apparatus. FIG. 3 is a timing chart showing a driving state of the display apparatus.

As shown in FIG. 1, a display apparatus SS of Embodiment 1 is constituted of a display controller 1 serving as a driving control device including a frame memory 1A, a data driver 2, a gate driver 3, a display part DD, a direct-current voltage power supply V for generating direct-current voltage of a constant voltage, and a switch SW.

Further, the display part DD is constituted of a plurality of pixels S arranged in a matrix form of n rows and m columns. In this case, the pixels S are numbered according to the rows and columns of the display part DD.

The data driver 2 and the pixels S are connected via data lines $D_1$ to $D_m$. The gate driver 3 and the pixels S are connected via gate lines $G_1$ to $G_n$.

The positive pole of the direct-current voltage power supply V is connected to the pixels S via the switch SW having been turned on and an anode line A. Meanwhile, the negative pole of the direct-current voltage power supply V is connected to the pixels S via a cathode line K.

The switch SW turns on/off the connection between the positive pole of the direct-current voltage power supply V and the anode line A in response to a switching signal outputted from the display controller 1 via a control line Ssw, which is connected to the display controller 1.

The data driver 2 outputs a data signal, which is provided for realizing a control pattern described later, via the data lines $D_1$ to $D_m$ to the pixels S in response to a driving signal outputted from the display controller 1 via a control line Sdd, which is connected to the display controller 1.

The gate driver 3 outputs a gate signal, which is provided for realizing a control pattern described later, via the gate lines $G_1$ to $G_n$ to the pixels S in response to a driving signal outputted from the display controller 1 via a control line Sdg, which is connected to the display controller 1.

When moving image information corresponding to a moving image to be displayed on the display part DD is transmitted from the outside via an information line Sdp to the display controller 1, a one-frame image of the moving image information is temporarily stored in the frame memory 1A, and the two driving signals are generated based on the stored image and are outputted to the data driver 2 and the gate driver 3.

In parallel with the above process, the display controller 1 controls the switching of the switch SW, generates the switching signal for realizing a display pattern of Embodiment 1, and outputs the signal via the control line Ssw to the switch SW.

Referring to FIG. 2, the following will describe the configuration of the pixel S in detail.

As shown in FIG. 2, the pixel S in the display part DD is constituted of transistors T and TT serving as a pixel-driving device and an active element, a capacitor C, and a light-emitting device E such as an organic EL light-emitting device.

In this configuration, the gate terminal of the transistor T is connected to the gate line G which corresponds to the pixel S, the source terminal of the transistor T is connected to the data line D which corresponds to the pixel S, and the drain terminal of the transistor T is connected to the gate terminal of the transistor TT, which is another transistor in the same pixel, and is connected to one terminal of the capacitor C in the same pixel S.

The other terminal of the capacitor C is grounded.

The source terminal of the transistor TT is connected to the anode line A, and the drain terminal of the transistor TT is connected to one terminal of the light-emitting device E.

The other terminal of the light-emitting device E is connected to the corresponding cathode line K.

In this circuit configuration, when the data signal is supplied via the data line D while the pixel S including the transistor T is selected according to the gate signal supplied via the gate line G, the transistor T is turned on by the selection according to the gate signal. Thus, the data signal is supplied to the capacitor C so as to charge the capacitor C. Further, when the gate terminal of the transistor TT increases in potential with charging voltage, the transistor TT is turned on.

In parallel with the above process, when direct-current voltage from the direct-current voltage power supply V is applied between the anode line A and the cathode line K in response to the switching of the switch SW, the direct-current voltage is applied as a driving source to the light-emitting device E via the transistor TT having been turned on. Hence, the light-emitting device E emits light only when the direct-current voltage is applied.

Referring to FIG. 3, the following will specifically describe display control in the display apparatus SS configured thus. In FIG. 3, scanning lines connected to one of the gate lines G, that is scanning lines constituted of pixels arranged along the row direction of FIG. 1 are represented as L1, L2, L3, . . . , $L_n$.

In FIG. 3, in an address period starting from the beginning of one vertical synchronizing period, firstly based on moving image information (specifically indicates luminance information for each of the pixels S to be illuminated, also in the following description) transmitted via the information line Sdp, the gate signal permits the selection of a scanning line L which includes the pixels S having the light-emitting devices E to be illuminated in the vertical synchronizing period including the address period. Subsequently, among the pixels S arranged on the selected scanning line L, the data signal is supplied to the pixels S including the light-emitting devices E to be actually illuminated and the capacitors C are charged.

At this point of the address period, a switching signal for turning off the switch SW is generated and is outputted to the switch SW.

Then, when the charging voltage of the capacitor C is increased by the charging of the data signal, the gate signal of the transistor TT is also increased in voltage. When the voltage exceeds a threshold value which is predetermined as a characteristic of the transistor TT, the transistor TT is turned on. According to the circuit configuration of FIG. 2, even when only the transistor TT is turned on, the light-emitting element E is not illuminated unless current voltage from the direct-current voltage power supply V is applied between the anode line A and the cathode K.

Subsequently, when the switching signal is outputted and the switch SW is turned on to illuminate the light-emitting device E only for predetermined illuminating period in the vertical synchronizing period, the direct-current voltage is applied between the anode terminal and the cathode terminal of the light-emitting device E, via the transistor TT having been turned on, by the switching operation. Current generated by the application of the direct-current voltage continues the illuminating operation of the light-emitting device E during the illuminating period. Beside, according to the circuit configuration of FIG. 2, the illuminating operation is performed on the light-emitting devices E in all of the selected pixels S and is continued until the end of the vertical synchronizing period as shown in FIG. 3 (indicated as "illuminating state" in FIG. 3). In this case, the switch SW remains turned on during the illuminating period.

Further, the light-emitting luminance of the illuminating operation is a luminance corresponding to luminance information serving as the moving image information.

Subsequently, the switching signal is outputted to turn off the switch SW after a lapse of one vertical synchronizing period during the illuminating operation, so that the illuminating operation is stopped and another vertical synchronizing period (address period) is started.

Then, the selection of the pixels S, the charging of the capacitors C, the standby until the start of the illuminating period, and the illuminating operation performed only in the illuminating period are repeated in all the vertical synchronizing periods, so that the illuminating operation is performed only in the illuminating period of the vertical synchronizing period.

As described above, according to the operation of the display apparatus SS of Embodiment 1, the light-emitting devices E in the pixels S are driven to display an image only in the illuminating period shorter than the vertical synchronizing period. Thus, it is possible to reduce the influence of an afterimage in human vision and control the display of a fast moving image with higher quality.

(II) Embodiment 2

Figure 4:
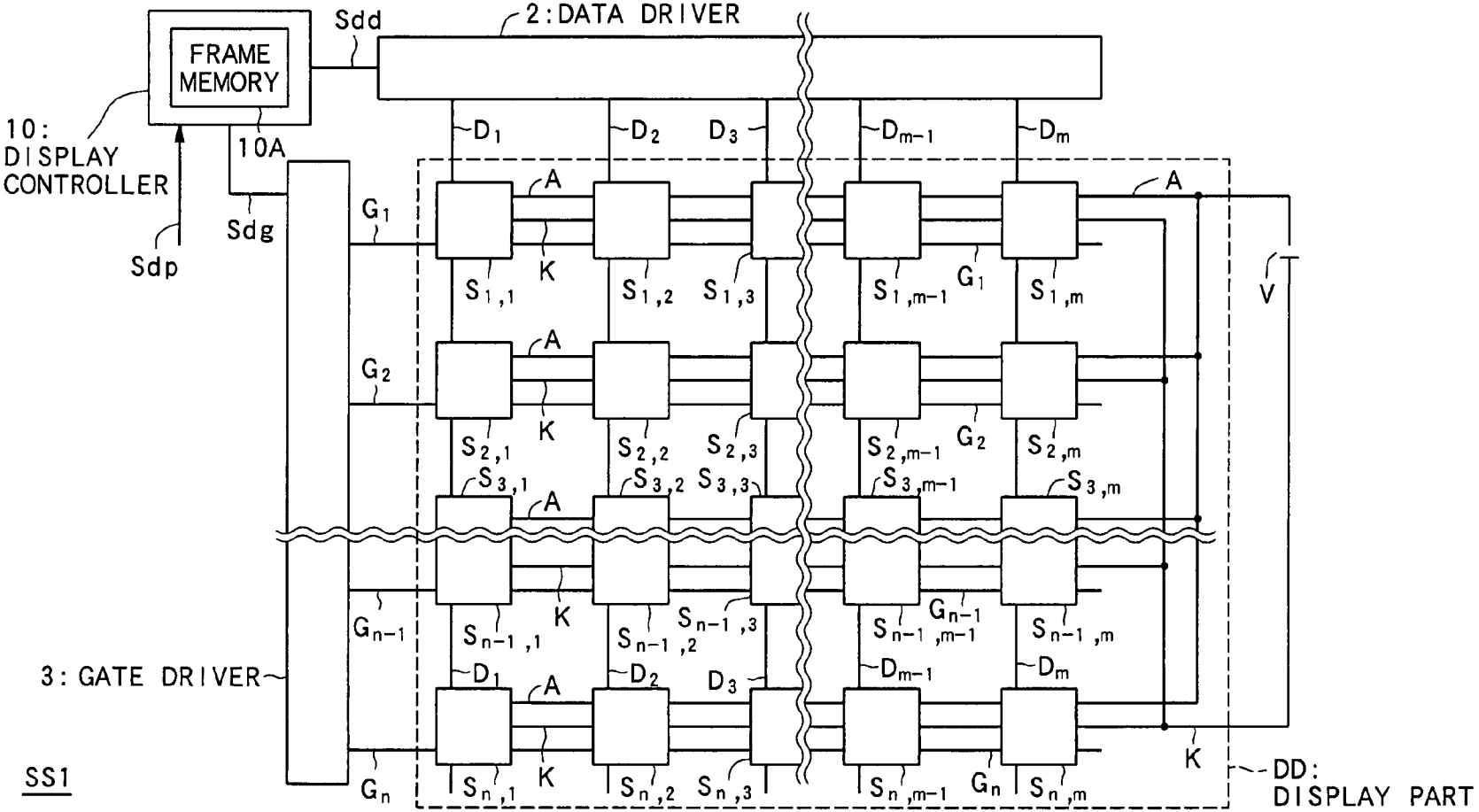
FIG. 4 is a block diagram showing the schematic configuration of a display apparatus according to Embodiment 2.
Figure 5:
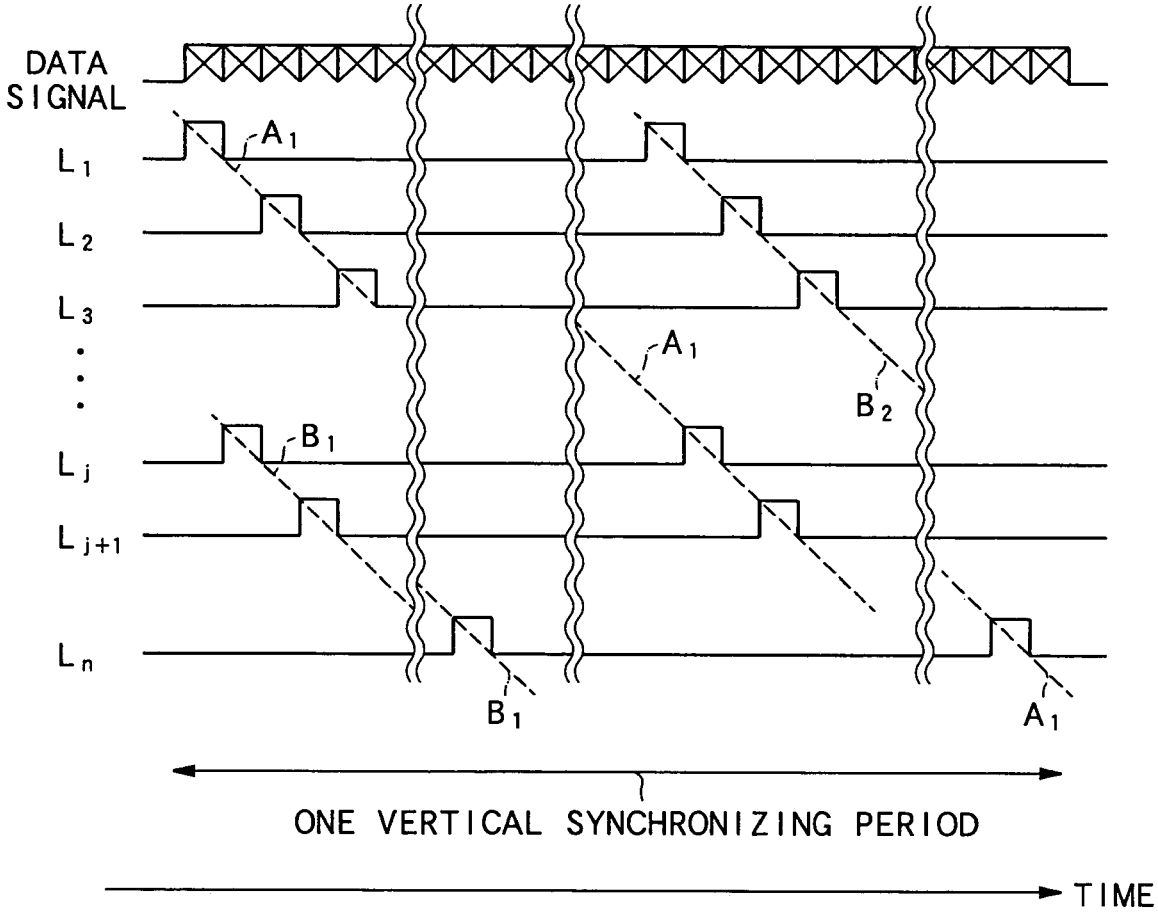
FIG. 5 is a timing chart (I) showing a driving state of the display apparatus according to Embodiment 2.
Figure 6:
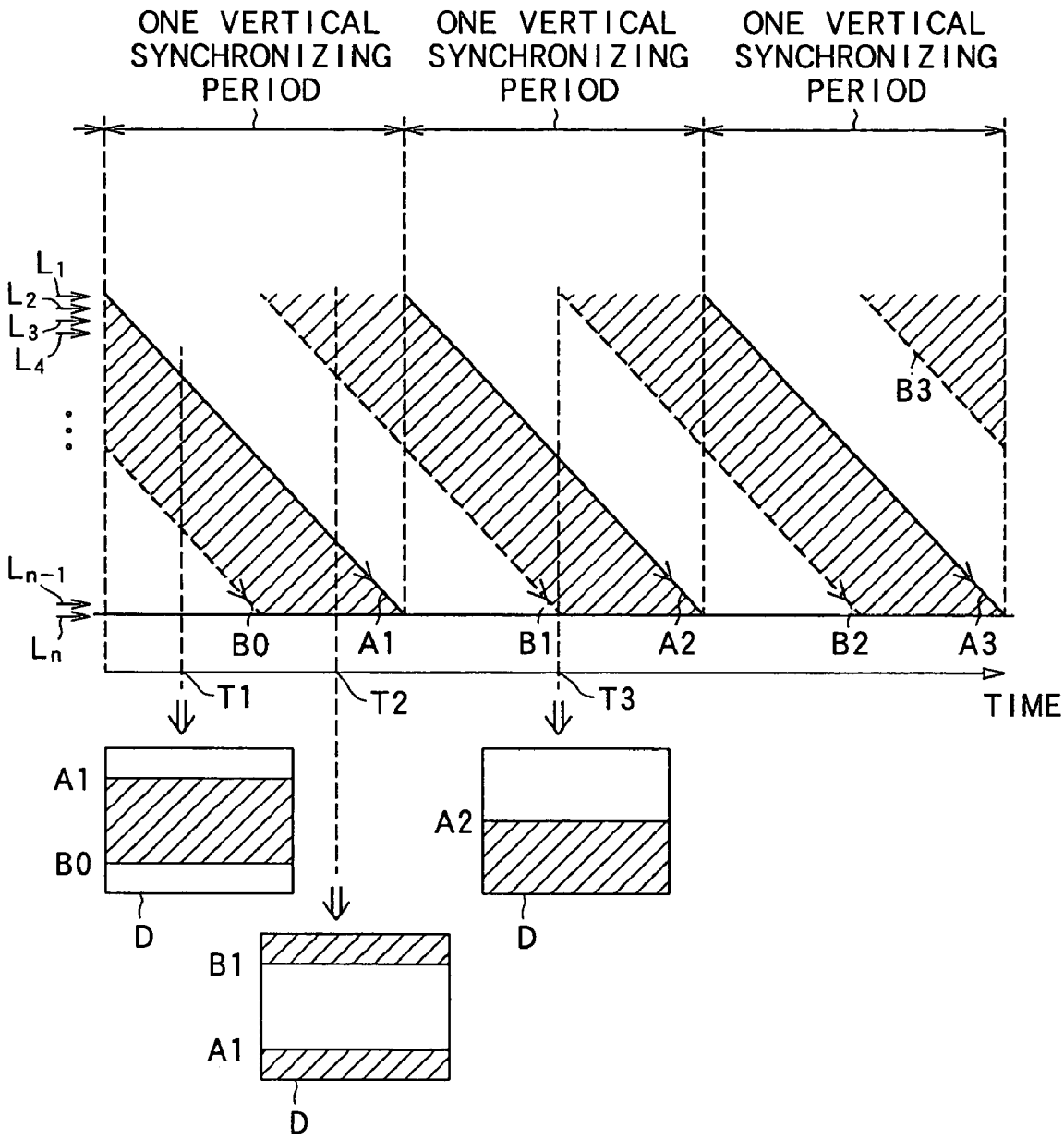
FIG. 6 is a timing chart (II) showing a driving state of the display apparatus according to Embodiment 2.

Referring to FIGS. 4 to 6, the following will describe Embodiment 2, which is another embodiment of the present application.

FIG. 4 is a block diagram showing the schematic configuration of a display apparatus according to Embodiment 2. FIG. 5 is a timing chart showing a driving state of the display apparatus in a vertical synchronizing period. FIG. 6 is a timing chart showing driving states in a plurality of vertical synchronizing periods of the display apparatus.

In FIG. 4, the same components as the display apparatus SS of Embodiment 1 shown in FIGS. 1 and 2 are indicated by the same reference numerals and the detailed explanation thereof is omitted.

The above-described display apparatus SS of Embodiment 1 is configured so that all the light-emitting devices E are simultaneously illuminated only during the predetermined illuminating period in the vertical synchronizing period. In Embodiment 2 below, an image is displayed by simultaneously driving light-emitting devices E on a plurality of adjacent scanning lines L, and is displayed by driving light-emitting devices E on a plurality of adjacent scanning lines L in a direction perpendicular to the scanning direction of the scanning line L while displacing the scanning line L one after another.

As shown in FIG. 4, a display apparatus SS1 of Embodiment 2 is constituted of a direct-current voltage power supply V and a display controller 10 including a frame memory 10A in addition to the data driver 2, the gate driver 3, and the display part DD in the display apparatus SS of Embodiment 1. The direct-current voltage power supply V is directly connected to an anode line A and a cathode line K which are connected to pixels S.

At this point, the positive pole of the direct-current voltage power supply V is directly connected to the anode line A and the negative pole thereof is directly connected to the cathode line K.

Like the display controller 1 of Embodiment 1, the display controller 10 is connected to the data driver 2 and the gate driver 3 via control lines Sdd and Sdg. Moving image information to be displayed on a display part DD is transmitted from the outside via an information line Sdp.

Referring to FIGS. 5 and 6, the following will specifically describe display control in the display apparatus SS1 configured thus. As FIG. 3 of Embodiment 1, scanning lines which are constituted of pixels S connected to one gate line G are represented as L1, L2, L3, . . . , $L_n$ in FIGS. 5 and 6.

In FIG. 5, in the first half of one vertical synchronizing period, firstly based on moving image information transmitted via the information line Sdp, a gate signal permits the selection of the scanning lines L which include the pixels S having the light-emitting devices E to be illuminated in the vertical synchronizing period. Subsequently, among the pixels S arranged on the selected scanning lines L, a data signal is supplied line-sequentially to the pixels S including the light-emitting devices E to be actually illuminated, so that capacitors C are charged. In this case, direct-current voltage generated by the direct-current voltage power supply V is always applied between the anode line A and the cathode line K during the vertical synchronizing period.

Therefore, the capacitor C of FIG. 2 is increased in charging voltage by the selection and charging performed by the data signal. As Embodiment 1, when the transistor TT is turned on, the direct-current voltage is applied between the anode terminal and the cathode terminal of the light-emitting device E via the transistor TT having been turned on. Current generated by the application of the direct-current voltage line-sequentially starts illuminating the light-emitting devices E.

In FIG. 5, a change (displacement) in the timing of starting the illuminating operation on each of the scanning lines L is indicated by broken lines "A1". The illuminating operation is started immediately after the pixels S to be illuminated are selected line-sequentially and the charging of the corresponding capacitors C is completed.

Once the illuminating operation is started, according to the circuit configuration of the pixel S shown in FIG. 2, the illuminating operation is continued for equal illuminating period on each of the scanning lines L until an extinguishing operation is performed.

Subsequently, according to the display control of Embodiment 2, in the last half of one vertical synchronizing period, the extinguishing operation on the currently illuminated light-emitting devices E is started, in the starting order of the illuminating operation (the order indicated by the broken lines A1), for each of the scanning lines L having the illuminated pixels S.

The extinguishing operation will be specifically discussed below. In the last half of one vertical synchronizing period, the gate signal permits the selection of the scanning lines L which include the pixels S having the light-emitting devices E to be extinguished. Subsequently, among the pixels S arranged on the selected scanning lines L, an extinguishing signal (not shown) is supplied line-sequentially to the pixels S including the light-emitting devices E to be extinguished, so that the illuminating operation on the light-emitting devices E is stopped. Thus, the extinguishing operation is line-sequentially performed on the light-emitting devices E.

In FIG. 5, a broken line "B2" indicates a change (displacement) in the timing of starting the extinguishing operation on each of the scanning lines L after the illuminating operation is started on the light-emitting devices E for each of the scanning lines L at the timing of the broken lines A1. The extinguishing operation is line-sequentially started on each of the illuminated pixels S for each of the scanning lines L.

Once, the extinguishment is performed, the extinguishment is continued until another illuminating operation is started on each of the scanning lines L in the subsequent vertical synchronizing period.

In FIG. 5, broken lines "B1" indicate the timing of extinguishing the pixels S line-sequentially on the scanning lines L immediately before the illuminating operation is started line-sequentially at the timing of the broken lines A1.

Referring to FIG. 6, the following will describe a change in display pattern over a plurality of vertical synchronizing periods when the illuminating operation and the extinguishing operation are repeated according to the timing of FIG. 5 in each vertical synchronizing period.

When the illuminating operation and the extinguishing operation are repeated according to the timing of FIG. 5, the illuminating operation and the extinguishing operation are repeated line-sequentially as FIG. 6 over the plurality of vertical synchronizing periods. In FIG. 6, the timing of starting the illuminating operation on the scanning lines L is indicated by reference numerals A1, A2, A3, . . . . The timing of starting the extinguishing operation is indicated by reference numerals B0, B1, B2, . . . .

For example, in a display screen D at timing T1 of FIG. 6, the pixels S are illuminated only an area above the scanning line L where the illuminating operation is started at timing "A1" of FIG. 6 and an area below the scanning line L where the extinguishing operation is started at timing "B0" of FIG. 6. The pixels S are extinguished at the center of the display screen D.

In the display screen D at timing T2 of FIG. 6, the pixels S are illuminated only in an area above the scanning line L where the extinguishing operation is started at timing "B1" of FIG. 6 and an area below the scanning line L where the illuminating operation is started at timing "A1" of FIG. 6. The pixels S are illuminated at the center of the display screen D.

Further, at timing T3 of FIG. 6, that is at the timing of starting the extinguishing operation at the lowest scanning line L in the display screen D, the pixels S of the display screen D are illuminated only in an area above the scanning line L where the illuminating operation is started at timing "A2" of FIG. 6.

In this way, according to the display pattern of the display apparatus SS1 in Embodiment 2, a strip-shaped illuminating area constituted of the adjacent two or more scanning lines L is moved from top to bottom in appearance in the display screen D, so that a moving image is displayed.

As described above, according to the operation of the display apparatus SS1 in Embodiment 2, an image is displayed by driving the light-emitting devices E only during the illuminating period shorter than the vertical synchronizing period. Thus, it is possible to reduce the influence of an afterimage in human vision and control the display of a fast moving image with higher quality.

Further, since image processing can be performed on the inputted moving image information almost in real time, the frame memory 10A of FIG. 4 can be omitted.

(III) Embodiment 3

Figure 7:
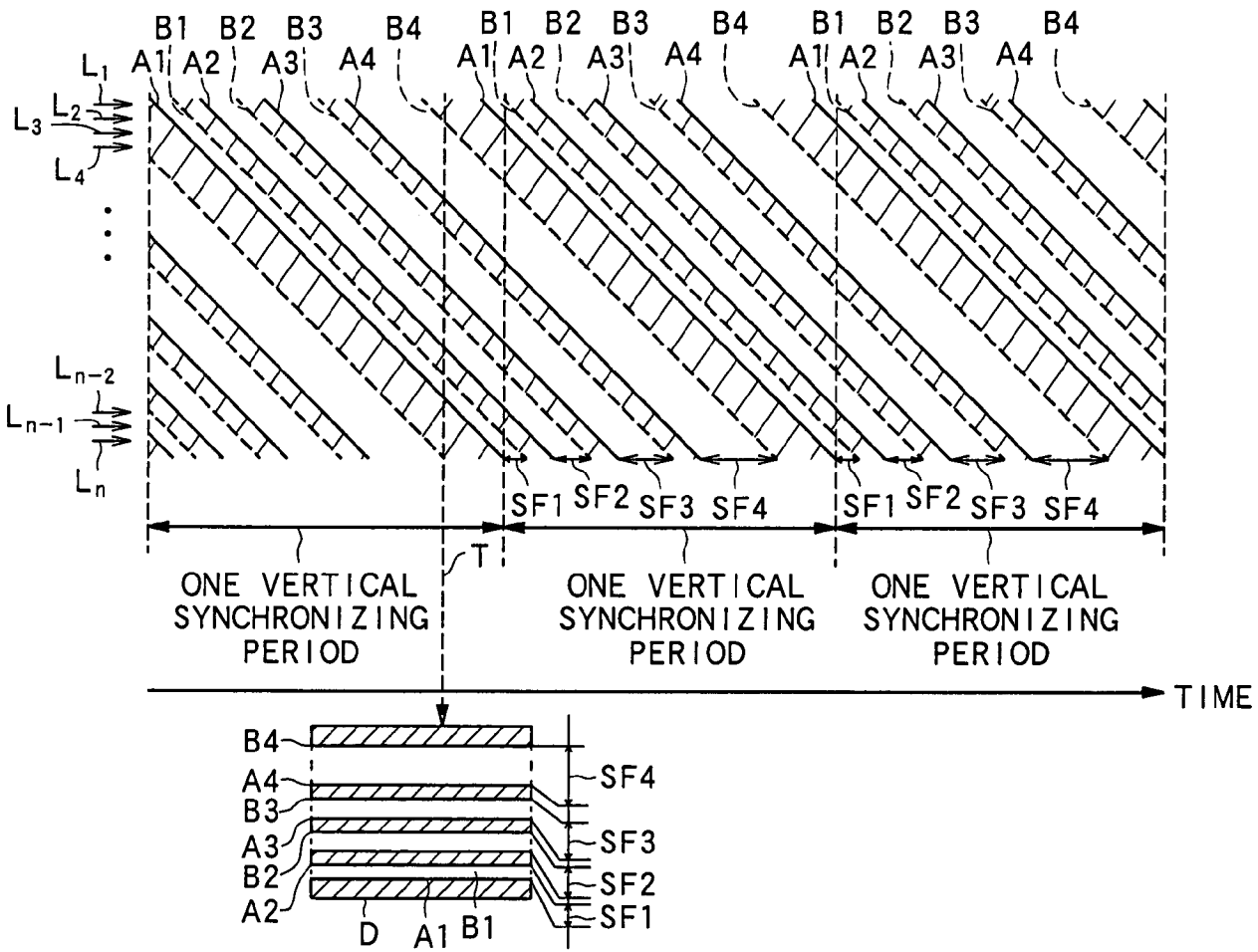
FIG. 7 is a timing chart showing a driving state of a display apparatus according to Embodiment 3.

Referring to FIG. 7, the following will describe Embodiment 3, which is another embodiment of the present application.

FIG. 7 is a timing chart showing driving states in a plurality of vertical synchronizing periods of a display apparatus according to Embodiment 3. Like FIG. 3 of Embodiment 1, scanning lines which are constituted of pixels S connected to one gate line G are represented as L1, L2, L3, . . . , and $L_n$.

Further, since the configuration of the display apparatus of Embodiment 3 is similar to that of Embodiment 2, the detailed explanation thereof is omitted.

Regarding the above-described display apparatus SS1 of Embodiment 2, the above explanation described that one strip-shaped illuminated area constituted of two or more adjacent scanning lines L is moved from top to bottom in appearance in the display screen D, so that a moving image is displayed. In Embodiment 3 below, a plurality of strip-shaped illuminating areas, each of them constituted of adjacent two or more scanning lines L, are moved from top to bottom in appearance in a display screen D, so that a moving image is displayed. In other words, the display screen D (i.e., one field) is divided into a plurality of subfields and illumination is performed thereon, so that a moving image is displayed. Further, a gray scale display is provided by display control using the subfields. At this point, moving image information inputted from the outside via an information line Sdp is converted into an n-bit (4 bits in FIG. 7) data signal by a display controller, so that $2^n$-level gray scale is displayed.

To be specific, as shown in FIG. 7, the display period of one field is constituted of four subfields SF1 to SF4 in Embodiment 3 below. Light-emitting devices E on scanning lines L included in the subfields SF are illuminated only for an illuminating period corresponding to a weight of bit digits in the converted data signal (specifically 1:2:4:8 from the subfield SF1), and a moving image is displayed while gray scale of $16(=2^4)$ levels is displayed.

As shown in FIG. 7, according to the display apparatus of Embodiment 3, in one vertical synchronizing period, firstly based on the moving image information transmitted via the information line Sdp, a gate signal permits the selection of the scanning lines L which include the pixels S having the light-emitting devices E to be illuminated in the subfield SF1. Subsequently, among the pixels S arranged on the selected scanning lines L, the data signal is supplied, in the subfield SF1, line-sequentially to the pixels S including the light-emitting devices E to be actually illuminated, so that capacitors C are charged. When a transistor TT in each of the pixels S is turned on and direct-current voltage is applied between the anode terminal and the cathode terminal of the light-emitting device E, the illuminating operation of the light-emitting device E is performed line-sequentially in the subfield SF1 by current generated by the application of the direct-current voltage.

In FIG. 7, a solid line "A1" indicates a change in the timing of starting the illuminating operation on each of the scanning lines L constituting the subfield SF1. The illuminating operation is started immediately after the pixels S to be illuminated are selected line-sequentially and the charging of the corresponding capacitors C is completed.

Once the illuminating operation is started in the subfield SF1, according to the circuit configuration of the pixel S of FIG. 2, the illuminating operation is continued for equal illuminating period on each of the scanning lines L until an extinguishing operation (described later) is performed in the subfield SF1 as shown in FIG. 7.

When the illuminating period for the subfield SF1 is completed, the extinguishing operation for the subfield SF1 is started on the currently illuminated light-emitting devices E for each of the scanning lines L having the illuminated pixels S. The extinguishing operation is performed in the order of stating the illuminating operation (the order indicated by the solid line A1).

To be specific, in the extinguishing operation, the gate signal permits the selection of the scanning line L which includes the pixels S having the light-emitting devices E to be extinguished in the subfield SF1. Subsequently, among the pixels S arranged on the selected scanning line L, an extinguishing signal (not shown) is line-sequentially supplied to the pixels S including the light-emitting devices E to be extinguished, so that the illuminating operation performed on the light-emitting devices E is stopped. Thus, the extinguishing operation is line-sequentially performed on the light-emitting devices E.

In FIG. 7, a broken line "B1" indicates a change in the timing of starting the extinguishing operation on each of the scanning lines L after the illuminating operation is started on the light-emitting devices E in the subfield SF1 for each of the scanning lines L at the timing of the solid line A1. The extinguishing operation is started line-sequentially on each of the illuminated pixels S on the scanning lines L.

Once the light-emitting devices E are extinguished in the subfield SF1, the extinguishing state is maintained until another illuminating operation is started for each of the scanning lines L in the subsequent subfield SF2.

When the illuminating operation and extinguishing operation for the subfield SF1 are completed thus, the gate signal permits, based on the moving image information, the selection of the scanning lines L which include the pixels S having the light-emitting devices E to be illuminated in the subfield SF2. Thereafter, the light-emitting devices E are illuminated line-sequentially in the subfield SF2 as in the subfield SF1.

In FIG. 7, a solid line "A2" indicates a change in the timing of starting the illuminating operation on each of the scanning lines L constituting the subfield SF2.

Once the illuminating operation is started in the subfield SF2, the illuminating operation is continued for equal illuminating period on each of the scanning lines L until an extinguishing operation (described later) is performed on the subfield SF2 as shown in FIG. 7. The illuminating period of the subfield SF2 is twice that of the subfield SF1.

When the illuminating period of the subfield SF2 is completed, the extinguishing operation for the subfield SF2 is performed on the currently illuminated light-emitting devices E line-sequentially on the scanning lines L having the illuminated pixels S. The extinguishing operation is performed in the order of stating the illuminating operation (the order indicated by the solid line A2).

In FIG. 7, a broken line "B1" indicates a change in the timing of starting the extinguishing operation on each of the scanning lines L after the illuminating operation for the subfield SF2 is started on the light-emitting devices E for each of the scanning lines L at the timing of the solid line A2. The extinguishing operation is started line-sequentially on each of the illuminated pixels S on the scanning lines L.

Once the light-emitting devices E are extinguished in the subfield SF2, the extinguishing state is maintained until another illuminating operation is started for each of the scanning lines L in the subsequent subfield SF3.

When the illuminating operation and extinguishing operation for the subfield SF2 are completed thus, the gate signal permits, based on the moving image information, the selection of the scanning lines L which include the pixels S having the light-emitting devices E to be illuminated in the subfield SF3. Thereafter, the illuminating operation for the light-emitting devices E is performed line-sequentially in the subfield SF3 as in the subfields SF1 and SF2.

In FIG. 7, a solid line "A3" indicates a change in the timing of starting the illuminating operation on each of the scanning lines L constituting the subfield SF3.

Once the illuminating operation is started in the subfield SF3, the illuminating operation is continued for equal illuminating period on each of the scanning lines L until an extinguishing operation is performed on the subfield SF3 as shown in FIG. 7. The illuminating period of the subfield SF3 is twice that of the subfield SF2.

When the illuminating period of the subfield SF3 is completed, the extinguishing operation for the subfield SF3 is performed on the currently illuminated light-emitting devices E line-sequentially on the scanning lines L having the illuminated pixels S. The extinguishing operation is performed in the order of stating the illuminating operation (the order indicated by the solid line A3).

In FIG. 7, a broken line "B3" indicates a change in the timing of starting the extinguishing operation on each of the scanning lines L after the illuminating operation for the subfield SF3 is started on the light-emitting devices E at the timing of the solid line A2 for each of the scanning lines L. The extinguishing operation is started line-sequentially on each of the illuminated pixels S on the scanning lines L.

Once the light-emitting devices E are extinguished in the subfield SF3, the extinguishing state is maintained until another illuminating operation is started for each of the scanning lines L in the subsequent subfield SF4.

Thereafter, the illuminating operation and extinguishing operation for the subfield SF4 are performed line-sequentially. The illuminating period of the subfield SF4 is twice that of the subfield SF3.

Besides, all the subfields SF have equal extinguishing time.

When the illuminating operations and extinguishing operations are completed in the four subfields SF1 to SF4, image display is completed in one vertical synchronizing period.

The following will describe a change in display pattern when the illuminating operation and the extinguishing operation are performed according to the timing of FIG. 7 in each of the subfields SF during one vertical synchronizing period.

When the illuminating operation and the extinguishing operation for each of the subfields SF are repeated according to the timing of FIG. 7, the light-emitting devices E are illuminated on the scanning lines L included in the subfields SF1 to SF4 and the light-emitting devices E are extinguished on the scanning lines L included in areas other than the subfields SF1 to SF4, for example, at timing T of FIG. 7 in the display screen D during one vertical synchronizing period.

According to the display pattern of the display apparatus in Embodiment 3, the subfields SF1 to SF4 each include two or more of the scanning lines L, and strip-shaped illuminating areas constituted of the scanning lines L (the widths are varied according to the weights of the subfields SF1 to SF4, to be specific the subfield SF1: the subfield SF2: the subfield SF3: the subfield SF4=1:2:4:8) are moved from top to bottom in appearance in the display screen D at intervals corresponding to the equal extinguishing time, so that a moving image is displayed.

As described above, according to the operation of the display apparatus of Embodiment 3, the light-emitting devices E are driven to display an image only during the illuminating period shorter than the vertical synchronizing period. Thus, it is possible to reduce the influence of an afterimage in human vision and control the display of a fast moving image with higher quality.

Selection writing scanning (scanning performed at the timing indicated by the solid lines A1, A2, A3, and A4 in FIG. 7) is performed in each of the subfields SF to place the pixels S on the corresponding scanning lines L into an image display state based on moving image information. Before the selection writing scanning is started on the scanning lines L, a non-display scanning (scanning performed at the timing indicated by the broken lines B1, B2, B3, and B4 in FIG. 7) is performed to place into an image non-display state all the pixels S on the scanning lines L to be subjected to the selection writing scanning. Hence, it is possible to reduce the occurrence of a moving image false contour when gray scale display is provided by the subfield method.

Embodiment 3 described that the light-emitting devices E are driven so that the scanning lines L included in the subfields SF to be scanned during the vertical synchronizing period are simply reduced in number along the vertical synchronizing direction. In addition, the same effect as the display apparatus of Embodiment 3 can be obtained by driving the light-emitting devices E are driven so that the scanning lines L included in the subfields SF to be scanned during the vertical synchronizing period are simply increased along the vertical synchronizing direction.

As described in the above embodiments, according to the operations of the display apparatus SS or SS1, an image is displayed by driving the light-emitting devices E of the pixels S only during the illuminating period shorter than the vertical synchronizing period. Thus, it is possible to reduce the influence of an afterimage in human vision and control the display of a fast dynamic image with higher quality.

Further, when an image is displayed by simultaneously driving the light-emitting devices E on the two or more adjacent scanning lines L and driving the light-emitting devices E on the scanning lines L so as to line-sequentially scan the plurality of scanning lines L, it is possible to more accurately control the display of a moving image.

Moreover, when an image is displayed by driving the light-emitting devices E on the scanning lines L so that the plurality of scanning lines L included in the subfields SF1 to SF4 are simultaneously scanned and the plurality of scanning lines L are line-sequentially scanned in the subfields SF1 to SF4, it is possible to perform control to clearly display the moving image even when gray scale display is provided for the moving image.

Additionally, when the light-emitting devices E are driven so that the scanning lines L included in the subfields SF to be scanned during the vertical synchronizing period are simply reduced in number along the vertical synchronizing direction, it is possible to correctly control the gray scale display in the display of the moving image. In other words, selection writing scanning (scanning performed at the timing indicated by the solid lines A1, A2, A3, and A4 in FIG. 7) is performed in each of the subfields SF to place the pixels S on the corresponding scanning lines L into an image display state based on the moving image information, and before the selection writing scanning is started on the scanning lines L, a non-display scanning (scanning performed at the timing indicated by the broken lines B1, B2, B3, and B4 in FIG. 7) is performed to place into an image non-display state all the pixels S on the scanning lines L to be subjected to the selection writing scanning. Hence, it is possible to perform control to clearly display the moving image even when gray scale display is provided for the moving image.

Furthermore, Embodiment 3 described that gray scale display is provided according to a length of the illuminating period on the assumption that the light-emitting device only performs a binary operation of illumination and extinguishment. In addition, the present application is also applicable to the case where the light-emitting intensity of the light-emitting device is changed according to an input video signal in an analog fashion to provide gray scale display. Further, the present application is also applicable to the case where the light-emitting intensity of the light-emitting device is changed in an analog fashion in each of the subfields to provide gray scale display.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2002-338405 filed on Nov. 21, 2002 including the specification, claims, drawings and summary is incorporated herein by reference in its entirety.

What is claimed is:

1. A display controller for controlling a display pattern of an image in a display apparatus having a plurality of pixels arranged in a matrix form, each pixel including a pixel-driving device, the display controller comprising:

a driving control device for controlling operation of the pixel-driving devices, based on image information corresponding to the image to be displayed during a synchronizing period of one synchronizing direction, only for predetermined illumination period shorter than the synchronizing period, wherein the synchronizing period in the image information is constituted of a plurality of sub synchronizing periods each having a different weight of an image display period, the driving control device performs selection writing scanning for line-sequentially scanning the pixel-driving device on the scanning line corresponding to the sub synchronizing period based on the image information and placing the pixel on the scanning line into an image display state in each of the sub synchronizing periods, and the driving control device performs non-display scanning for line-sequentially scanning the pixel-driving devices on the scanning line to be subjected to the selection writing scanning and placing all the pixels on the scanning line into an image non-display state before starting the selection writing scanning on the scanning line.

* * * * *